US005574796A

United States Patent [19]

Keezer

[11] Patent Number: 5,574,796

[45] Date of Patent: Nov. 12, 1996

[54] LOUDSPEAKER INSTALLING

[75] Inventor: William J. Keezer, Sherborn, Mass.

[73] Assignee: Bose Corporation, Farmingham, Mass.

[21] Appl. No.: 292,722

[22] Filed: Aug. 18, 1994

[51] Int. Cl.[6] ..... H04R 25/00

[52] U.S. Cl. ..... 381/188; 381/205; 381/124; 181/150; 181/148

[58] Field of Search ..... 181/150, 141, 181/148, 171, 172; 381/188, 205, 87, 88, 90, 24, 124, 152; 362/404, 147, 364, 365; 248/320, 322, 327, 343

[56] References Cited

U.S. PATENT DOCUMENTS 3,912,865 10/1975 Seebinger ..... 381/124

FOREIGN PATENT DOCUMENTS 59-4400 11/1984 Japan ..... 381/188

*Primary Examiner*—Curtis Kuntz
*Assistant Examiner*—Xu Mei
*Attorney, Agent, or Firm*—Fish & Richardson P.C.

[57] ABSTRACT

A mount for mounting a loudspeaker in a room boundary structure having an outside surface away from the inside of the room includes a frame constructed and arranged to rest on the outside surface. A spring has a first end attached to the frame and a free second end. The spring is constructed and arranged to exert a unidirectional force toward the outside surface whenever the second end of the spring is displaced from the outside surface toward the inside of the room.

7 Claims, 15 Drawing Sheets

LOUDSPEAKER INSTALLING

The present invention relates in general to loudspeaker installing and more particularly to installing loudspeakers in room boundary structures, such as walls and ceilings.

A typical approach for mounting loudspeakers is a torsion spring mount. Torsion springs typically have two stable states. The torsion spring mount is typically positioned in the ceiling, with the loudspeaker assembly suspended below the mount. The installer pushes the assembly toward the final mounting position. Upon reaching a transition point, the torsion spring changes from opposing assembly upward movement to aiding upward movement of the assembly into place.

According to the invention, there is a loudspeaker mount comprising a frame constructed and arranged to rest on an outside surface of a room boundary structure, such as a ceiling or a wall. At least one spring having first and second ends has its first end attached to the frame. The spring is constructed and arranged to furnish a unidirectional force at the second end away from the inside of the room whenever the second end is displaced from a retracted position toward the center of the room and an extended position. Typically the frame is formed with a set of support surfaces extending from a central aperture region constructed and arranged to engage the outside surface. A loudspeaker structure is attached to the second end so that the spring urges the loudspeaker structure through the central aperture region. It is within the principles of the invention to reverse the order of spring attachment, having the second end attached to the loudspeaker structure with the first end then free, and then attach the first end to the frame. According to a specific aspect of the invention, the frame has two identical halves with optional locking mechanisms securing the two halves together. According to another aspect, the frame is a single half.

Other features, objects and advantages of the invention will become apparent from the following detailed description when read in connection with the accompanying drawings in which:

FIGS. 1A, 1B, 1C and 1D are diagrammatic elevation views partially in section illustrating an embodiment of the invention helpful in understanding a method of installing a loudspeaker driver according to the invention;

FIGS. 2A, 2B, 2C and 2D similarly illustrate another embodiment with a loudspeaker structure comprising a driver and enclosure;

Figure 1A:
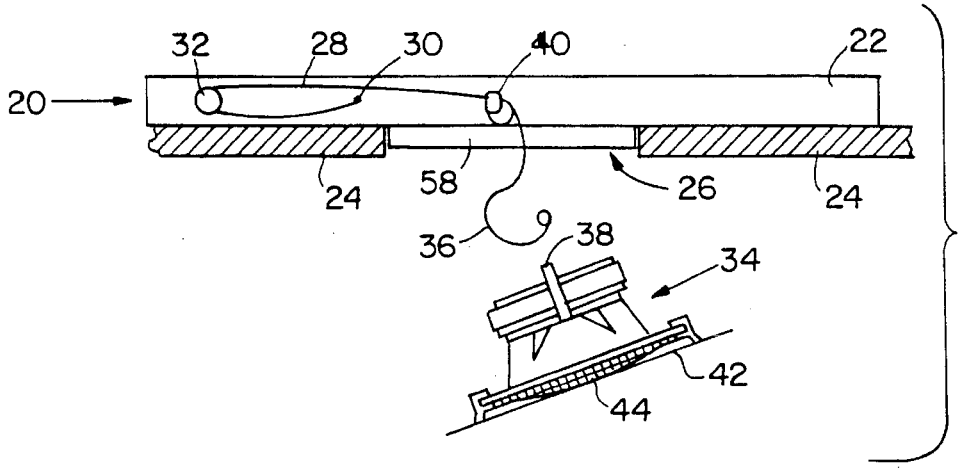

With reference now to the drawings, and more particularly to FIGS. 1A–1D, there are shown side views, partially in section of an exemplary embodiment of the invention illustrating steps in a method of mounting a loudspeaker in a ceiling according to the invention. Frame 22 of mount 20 is supported on ceiling 24 around hole 26. Spring 28 is connected to frame 22 at one end 30, is coiled about spring retainer 32, and extends distally toward hole 26 to engage loudspeaker 34. Distal end 36 of spring 28 is preferably hook shaped so that loop 38 on loudspeaker 34 may be easily engaged.

As shown in the sequence of FIGS. 1A–1D, a loudspeaker may be ceiling mounted by first inserting mount 20 through hole or aperture 26 in ceiling 24 and assembling it. Spring 28 is maintained in a compressed or extended position during this stage by its inside loop 28A being hooked over retention tab 40 such that hook-shaped distal end 36 extends below the lower surface of ceiling 24. Alternatively, insertion can occur with spring 28 uncompressed in a retracted position and distal end 36 up, pulling down distal end 38 after insertion.

Figure 1B:
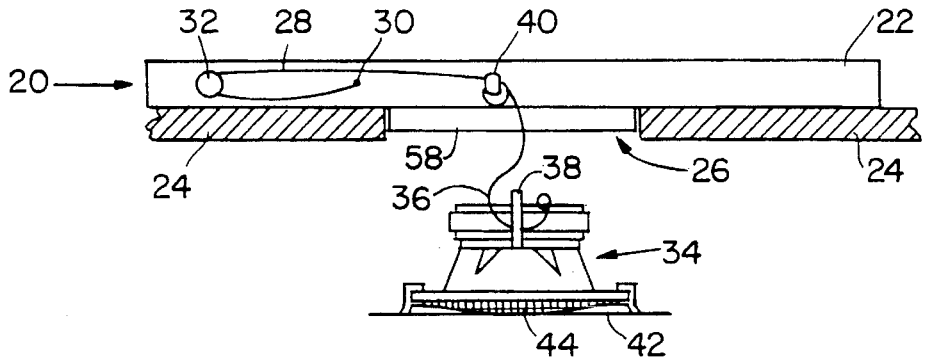
Figure 1C:
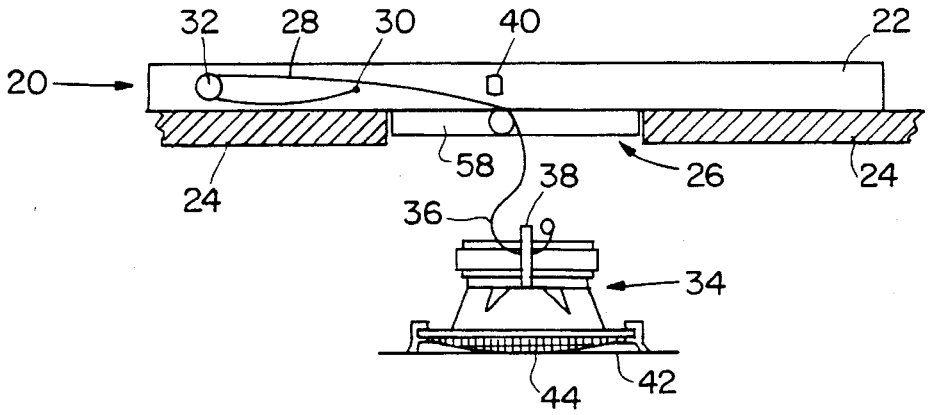
Figure 1D:
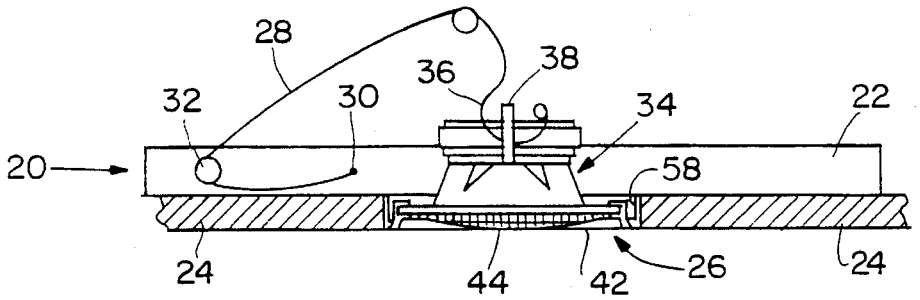

As shown in FIG. 1B, loop 38 of loudspeaker 34 then engages distal end 36 so that spring 28 supports loudspeaker 34. As shown in FIG. 1C, loudspeaker 34 is then pulled down, away from frame 22 to release spring 28 from retention tab 40. Finally, as shown in FIG. 1D, releasing loudspeaker 34 allows spring 28 to pull speaker 34 through hole 26 so that grill 42 covering loudspeaker face 44 is flush with the lower side of ceiling 24.

A feature of the invention is that because spring 28 continuously furnishes an upward force, a person installing a loudspeaker according to the method may avoid upward pressure on the mount. The mount may rest freely in the ceiling because there is nothing to cause the mount to move upward during speaker installation. Moreover, the downward force when spring 28 is released from retention tab 40 will cause mount 20 to more rigidly maintain its position.

Figure 2A:
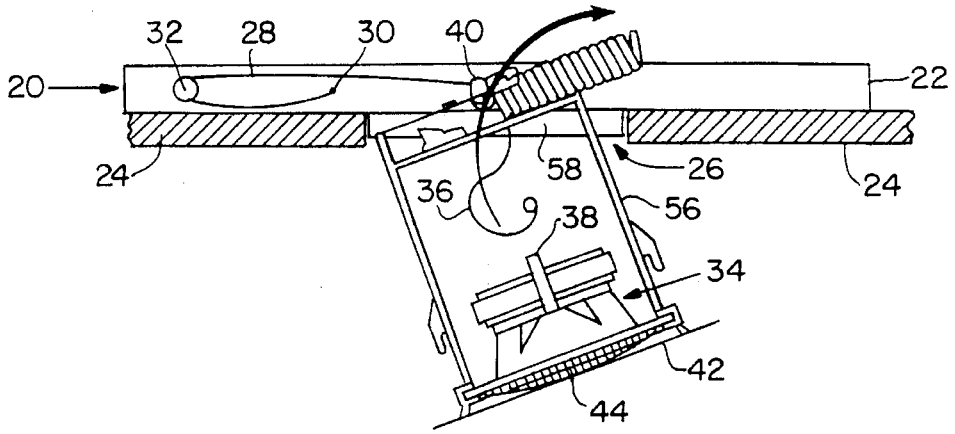
Figure 2B:
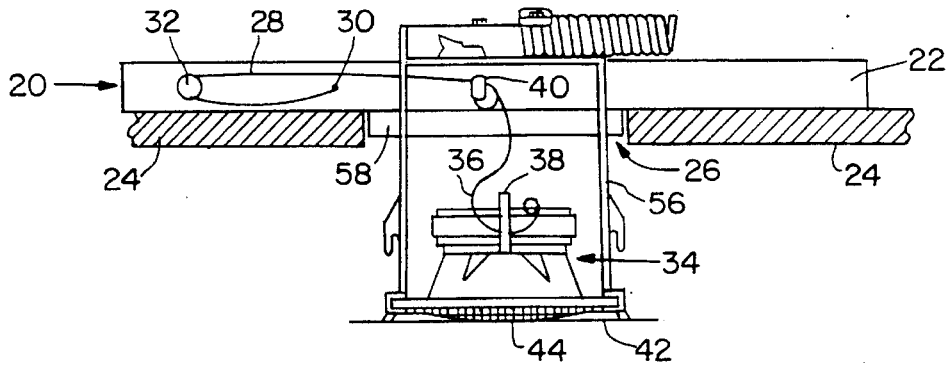
Figure 2C:
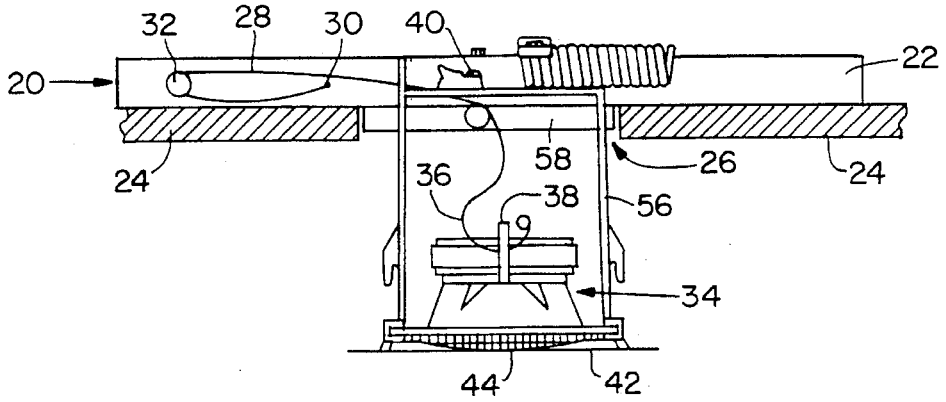
Figure 2D:
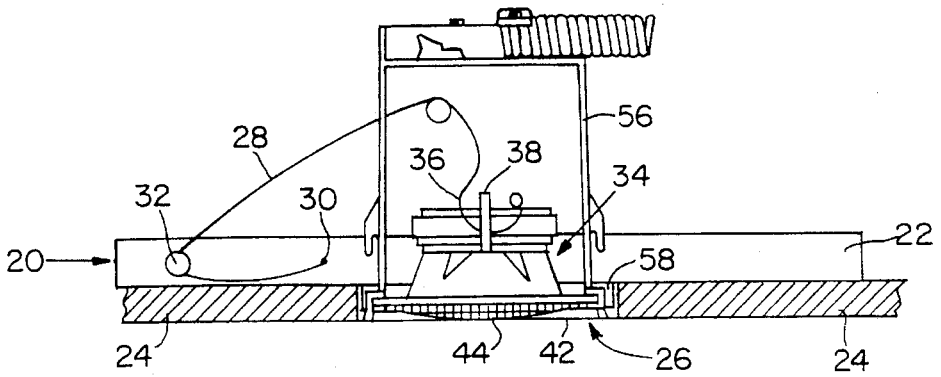

As shown in FIGS. 2A–2D, the same procedure may be used to install a loudspeaker driver encased within an enclosure. It may be desirable to tilt the enclosure, as shown in FIG. 2A, to move the enclosure through the hole.

Figure 3:
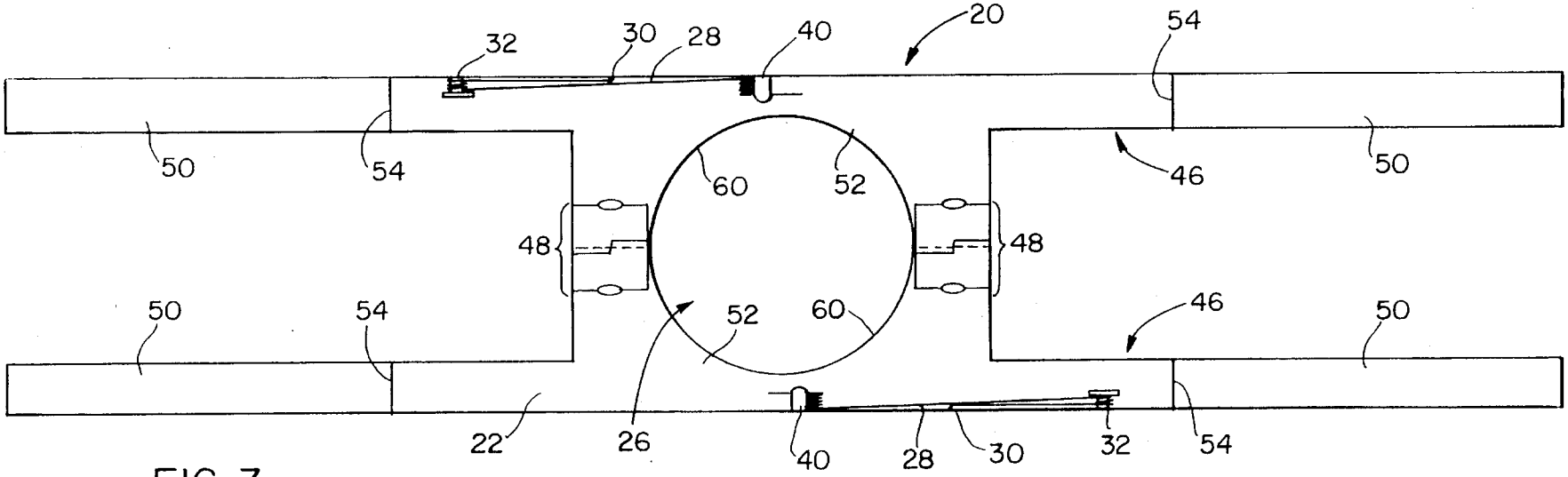
FIGS. 3 and 4 are top view and side views, respectively, of the above embodiments of the invention with speaker removed.
Figure 4:
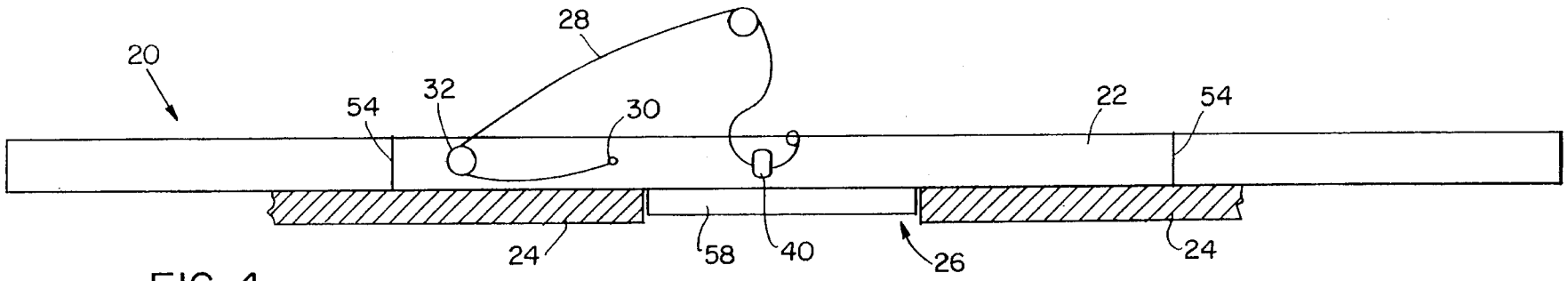
Figure 5:
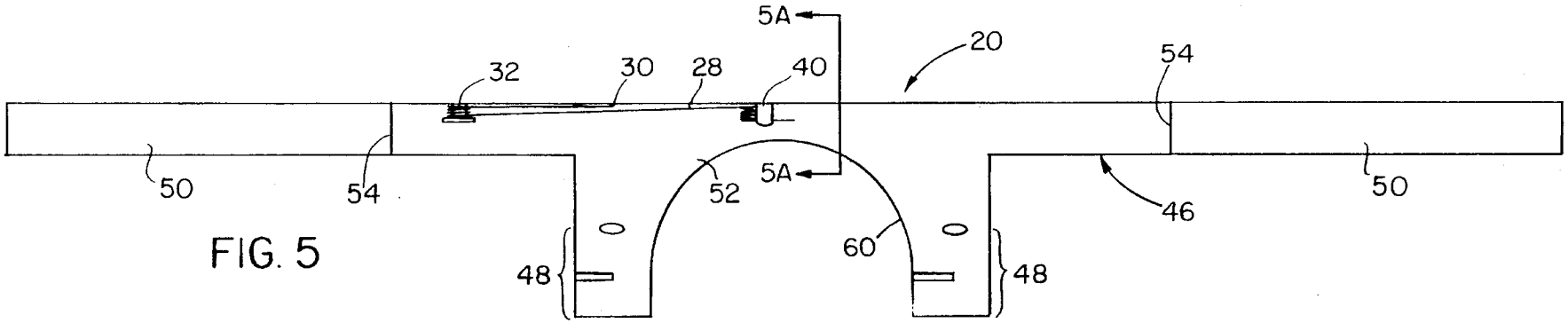
FIG. 5 is a plan view of half the exemplary embodiment of FIGS. 3 and 4.

Referring to FIGS. 3 and 4, there are shown plan and elevations views respectively of an embodiment of the invention comprising a mount of two identical halves 46 shown in plan view in FIG. 5. As shown in FIGS. 3 and 5, frame 22 may be formed from two identical halves 46 which are held together with locking snaps 48. It is preferable for frame 22 to comprise two pieces so that it may be inserted through a small hole in ceiling 26 and subsequently assembled. Frame 22 may also be assembled prior to insertion into hole 26 and may employ telescoping, folding, swiveling or other forms of support beams 50.

Each half 46 of bracket 20 has a pair of support beams 50 which extend away from a semicircular aperture region 52 arranged to encircle hole 26 in ceiling 24. It may be desirable for support beams 50 to be of different lengths depending on the strength of the ceiling material and the available installation space. To facilitate this, each of support beams 50 may be scored at one or more locations 54 along its length (only one scoring location has been shown for simplicity).

Lip 58 preferably extends from inside edge 60 of semicircular aperture region 52 to shield loudspeaker 34 from the inside edge of hole 26 and to prevent lateral displacement of mount 20 during installation.

Figure 5A:
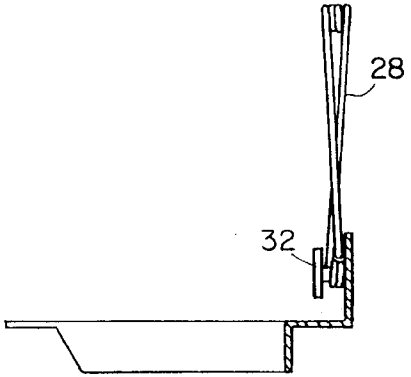
FIG. 5A is a front cross sectional view along the indicated circular projection.

As shown in FIG. 5A, spring 28 may be coiled around spring retainer 32. Spring retainer 32 is a pivot point to accommodate the twisting motion of spring 28 during installation of loudspeaker 34. Spring 28 is preferably coiled between eight and ten times about spring retainer 32 so that spring 28 is not permanently deformed during installation. While coiled springs may be preferable, straight springs, or springs with fewer or greater numbers of coils may be used.

Figure 6C:
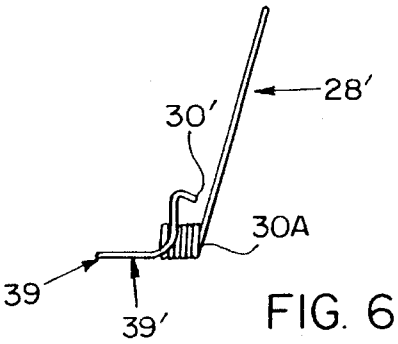
FIGS. 6A–6C are top, side and front views, respectively, of another form of spring.
Figure 6D:
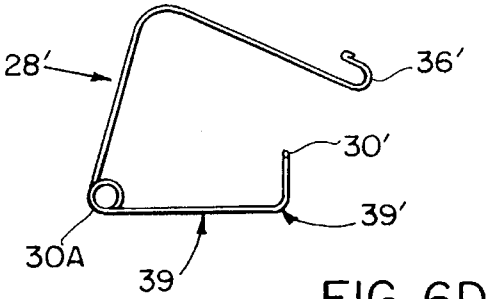
FIG. 6D is a side view of this form of spring compressed.
Figure 6A:
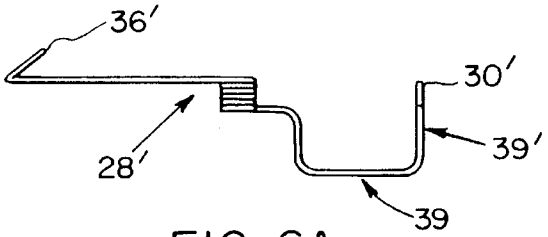
Figure 6B:
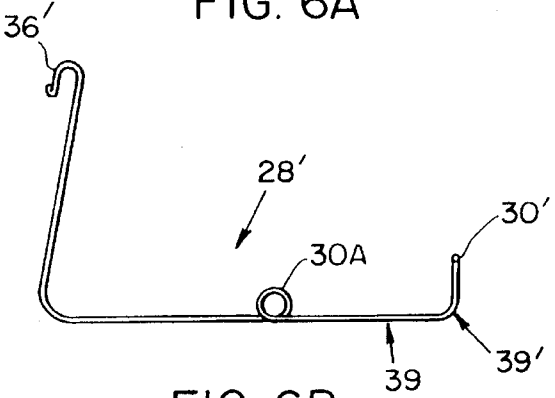

An exemplary alternative spring is shown in FIGS. 6A–6C. First end 30' of spring 28' is hook-shaped to replace the function of hook 40 in the concept shown in FIG. 5. Preferably, distal end 36' is hook-shaped to engage a loop of loudspeaker 34; however, distal end 36' may be formed in any suitable manner for attachment to loudspeaker 34. For example, distal end 36' could be formed in the shape of a loop to fit around a peg or hook on a loudspeaker. Distal end 36' formed in a suitable manner for attachment to loudspeaker 34 may be regarded as a free second end formed with engaging structure, such as hook-shaped or in the shape of a loop.

Spring 28' shown in its retracted position in FIGS. 6A, 6B and 6C is thus a coil 30A intermediate a first end portion extending to first end 30' and a second end portion extending to distal end 36'. Both end portions are generally L-shaped in the plane of the circular cross section 30A with the first portion being of generally U-shape in a second plane transverse to the first plane. FIG. 6D is an elevation view as seen in FIG. 6B but with spring 28' compressed in a typical form when positioned to retain a loudspeaker structure at distal end 36' against the ceiling.

Figure 7:
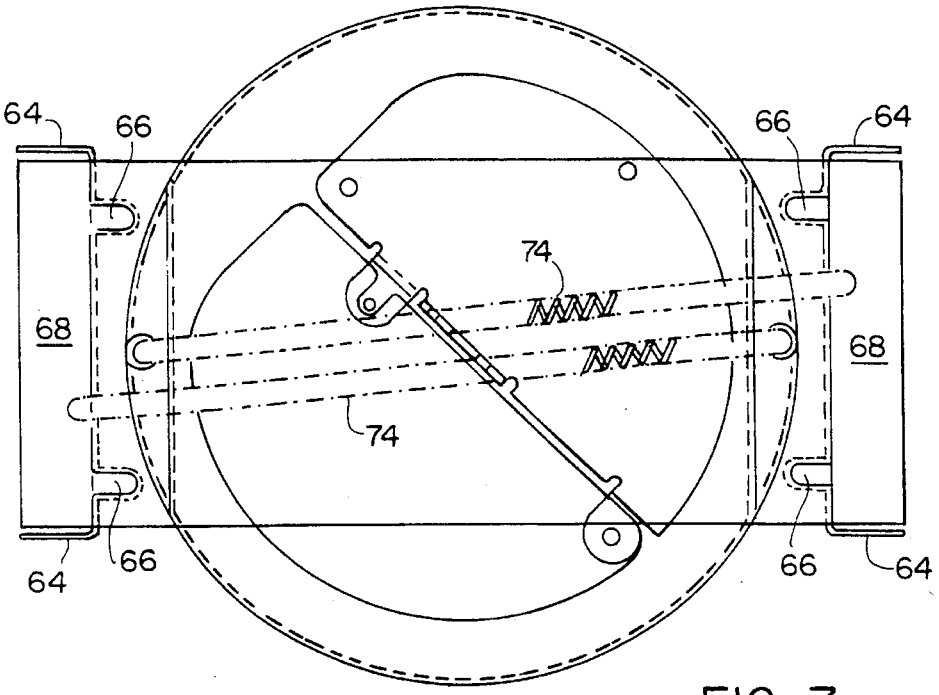
FIGS. 7 and 8 are plan and elevation views, partially in section, of an alternative embodiment of the invention with the mount comprising a U-shaped beam and coil springs.
Figure 8:
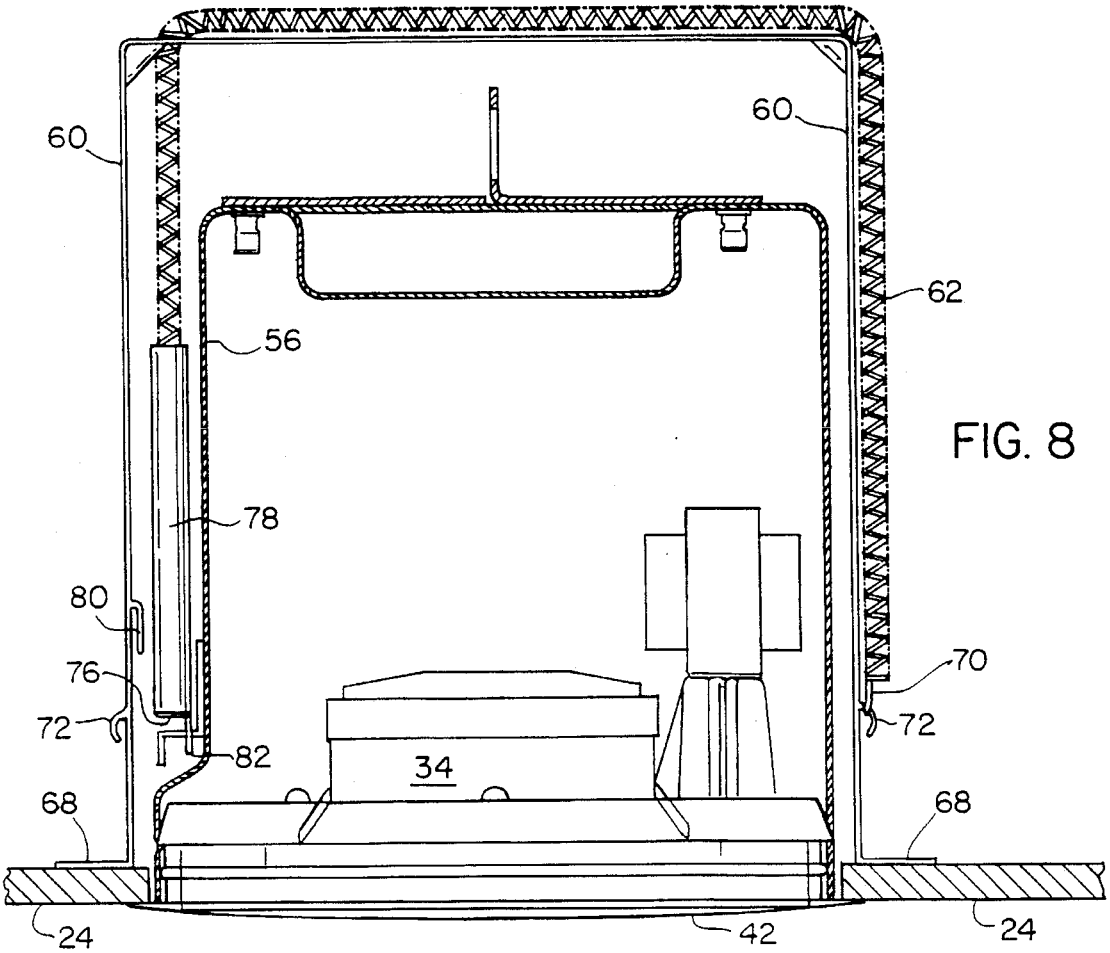

Referring now to FIGS. 7 and 8, there are shown plan and elevation views, respectively, partially in section of an alternative embodiment with the mount comprising a U-shaped beam 60 and coil spring 62. The bracket according to this alternative embodiment straddles hole 26 instead of extending beyond it as in the above embodiments.

U-Shaped beam 60 may be strengthened along its sides by bending a portion of the metal beam to form reinforcement bend 64. Alternatively, metal plates could be attached by any suitable method such as brazing, soldering, welding or by using bolts. The corners of U-shaped beam 60 may be strengthened by forming knees 66 in the metal or by attaching other suitable reinforcing members. Pads 68 are provided to rest on top of ceiling 24 and may be large or small depending on the amount of surface area required to distribute the weight of the bracket and loudspeaker. U-shaped beam 60 is preferably constructed of 20-gauge sheet metal or other similar material.

Coil spring 62 is attached at a first end 70 to retaining hook 72. Distal end 76 of coil spring 62 is preferably connected to sleeve 78. In the extended position the upper portion of sleeve 78 engages retainer hook 80.

Retaining hook 72 and retainer hook 80 may be formed directly from the U-shaped beam by cutting an arc or small U-shape, and bending the remaining tabular portion outward. Other well known methods of manipulating metal may also be employed to form retaining hook 72 and retainer hook 80 either directly from U-shaped beam 60 or from another piece of metal which is then attached to U-shaped beam 60.

To install a speaker or a speaker in an enclosure in a ceiling using the embodiment shown in FIGS. 7 and 8, sleeve 78 is first extended below the lower edge of ceiling 24 and hooked on retainer hook 80 so that loop 82 on the end of sleeve 78 remains relatively stationary below ceiling 24.

Speaker 34 or enclosure 56 is then hooked onto loop 82. Loop 82 may also be any attachment mechanism capable of engaging a loudspeaker such as a hook or clasp.

Coil spring 62 is then extended slightly to allow it to disengage retainer hook 80. After being disengaged, coil spring 62 pulls speaker 34 and enclosure 56 into hole 26 in ceiling 24. Speaker 34 or enclosure 56 will thereafter be held in place by friction forces and by the force exerted on it by coil spring 62.

Figure 9A:
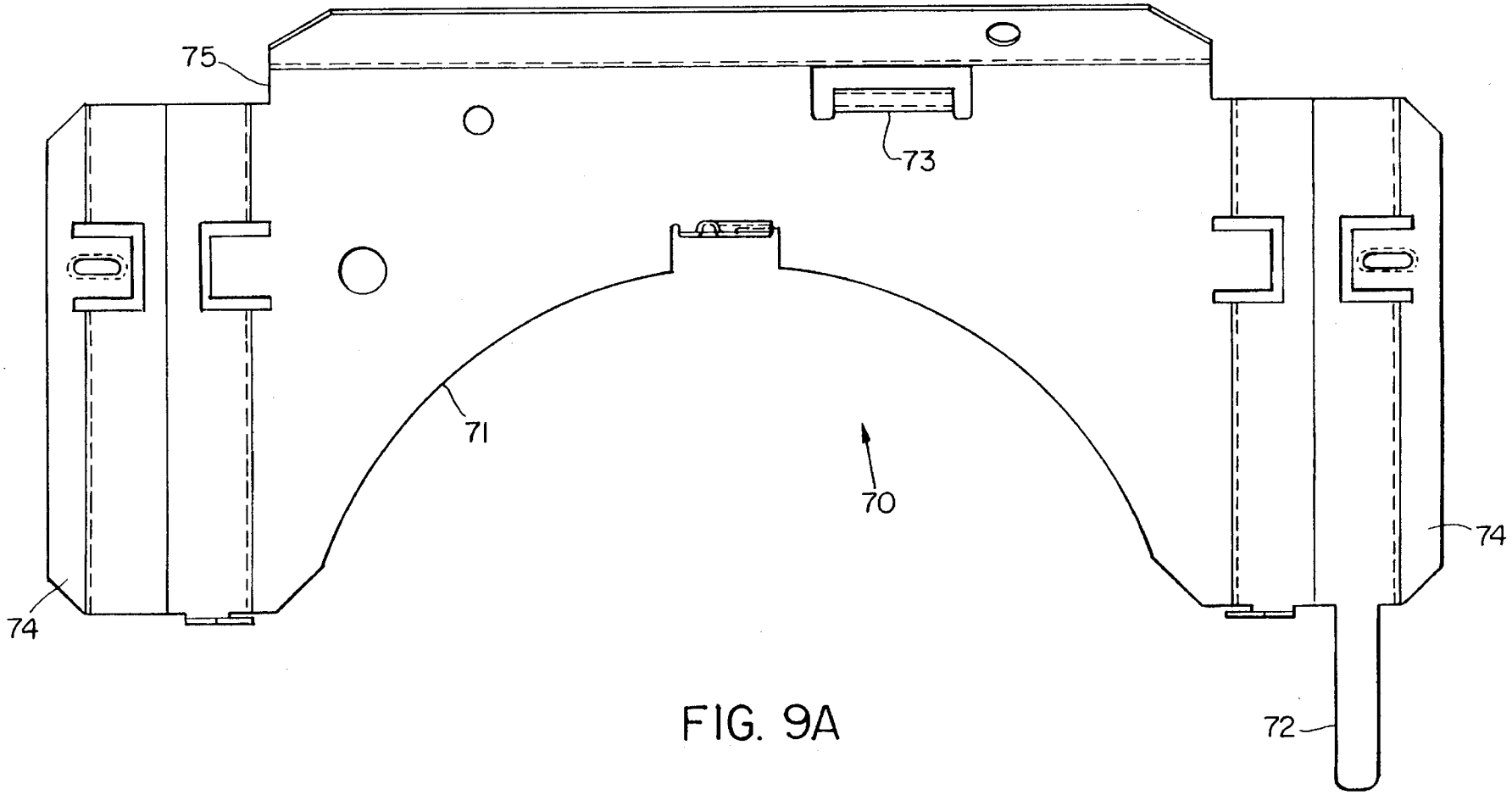
FIGS. 9A, 9B and 9C are plan, front elevation and side elevation views, respectively, of an advantageous mounting plate according to the invention.
Figure 9B:
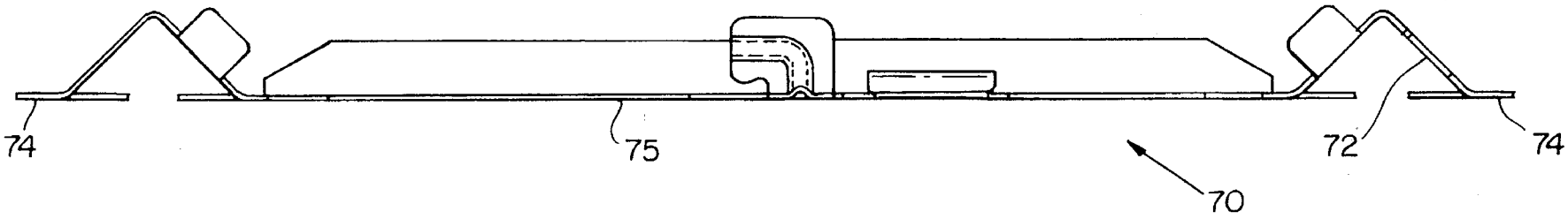
Figure 9C:
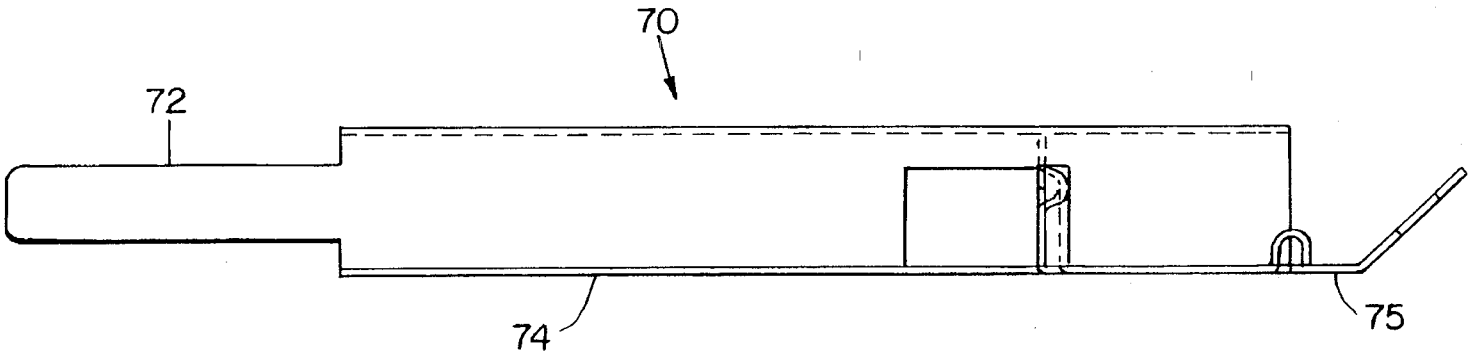

Referring to FIGS. 9A, 9B and 9C, there are shown plan, front elevation and side elevation views of an advantageous frame structure according to the invention having a substantially semicircular front edge 71 on mounting plate 70 formed with a spacer 72 for accommodating a larger diameter driver and bracket hook 73 for receiving section 39 of the spring of FIG. 6. Side flanges 74 and back flange 75 are constructed and arranged to contact the outside surface of the boundary structure, such as the ceiling. An advantage of this mount is that the single mounting plate 70 may be easily inserted through circular opening 26 from inside the room with semicircular edge 71 aligned along an edge of circular opening 26 to securely mount a loudspeaker structure. Furthermore, mounting plate 70 uses relatively little material, thereby reducing costs.

Figure 10A:
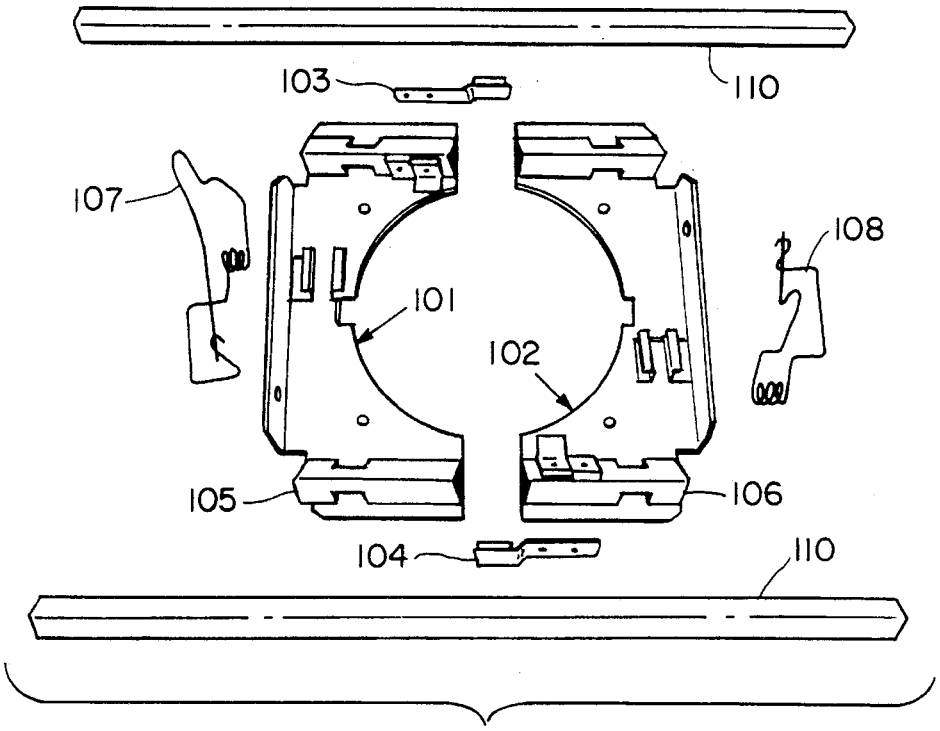
FIGS. 10A–10H and 10J–10T illustrate techniques for installing according to the invention.

Referring to FIGS. 10A–10H and 10J–10T, there are shown illustrations helpful in installing according to the invention using another two-piece pan structure and lifting torsion springs. FIG. 10A shows a layout of parts helpful in understanding terminology used in describing installing. There are inside semicircular edges 101 and 102 of brackets 105 and 106, respectively, spacers 103 and 104, springs 107 and 108 and rails 109 and 110.

Figure 10B:
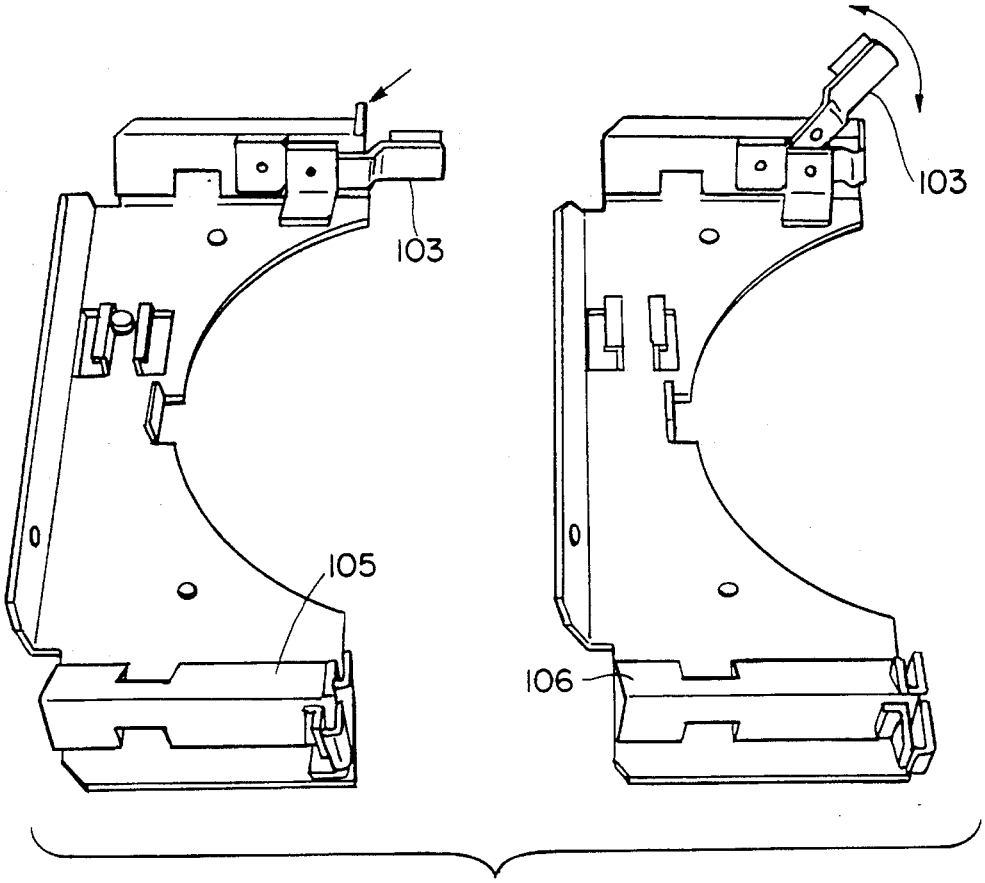

FIG. 10B shows a spacer 103 in place in bracket 105 at the left and being removed or installed in bracket 106 at the right. Spacers 103 are used to space brackets, such as 105 and 106, properly for a larger diameter driver when assembled on rails, such as 109 and 110.

Figure 10C:
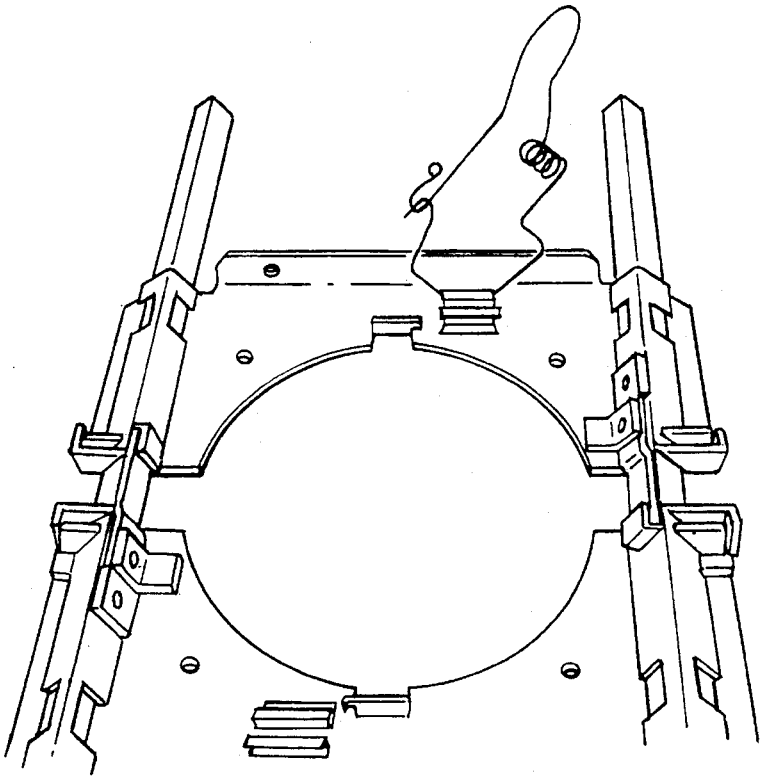

FIG. 10C shows installing a spring, such as 107 or 108, by placing a spring corner under a bracket hook, such as 111.

Figure 10D:
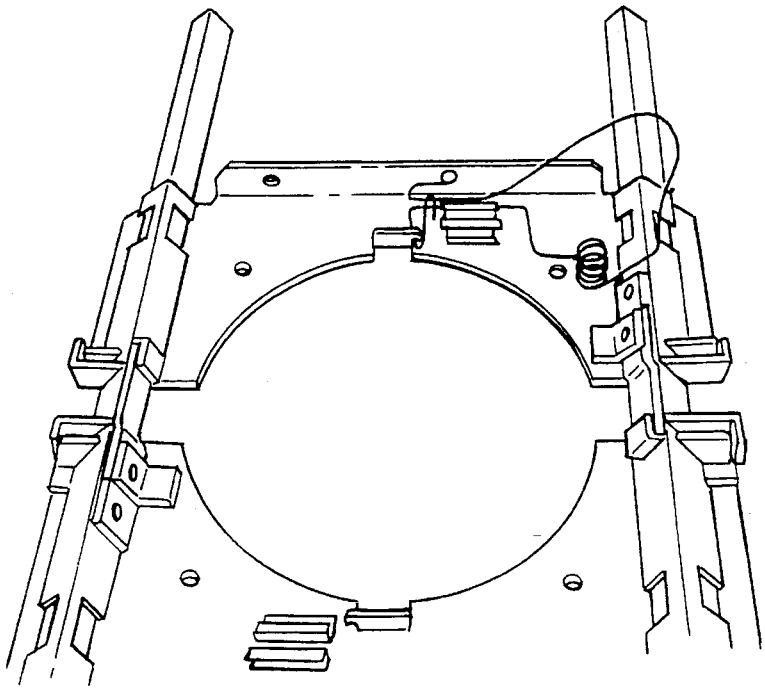

FIG. 10D shows rotating the spring flat with the bracket and snapped into place.

Figure 10E:
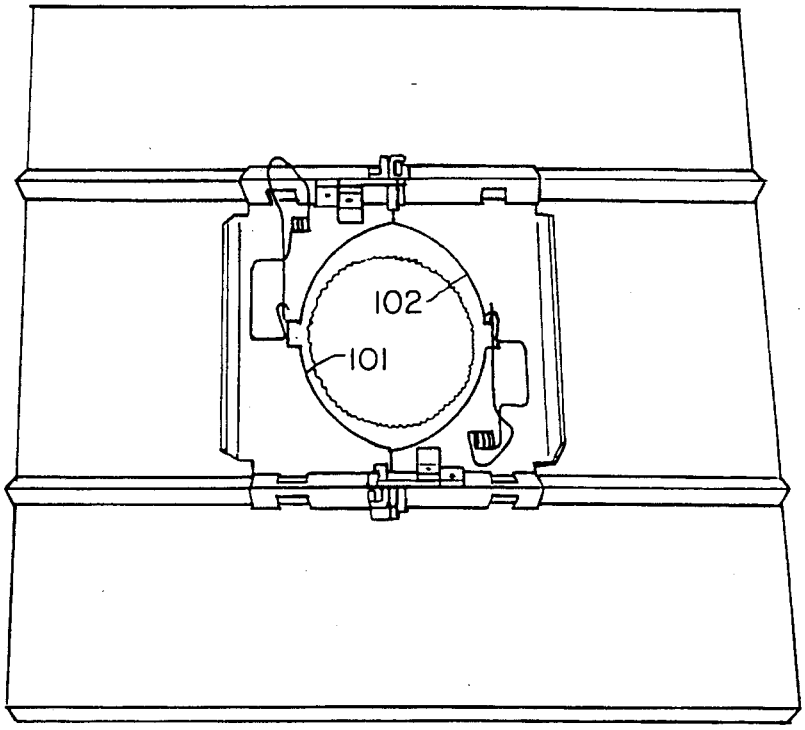

FIG. 10E shows the mounting system in place above a ceiling tile with the inside edges 101 and 102 closely spaced for a small opening to accommodate a speaker or enclosure of smaller diameter.

Figure 10F:
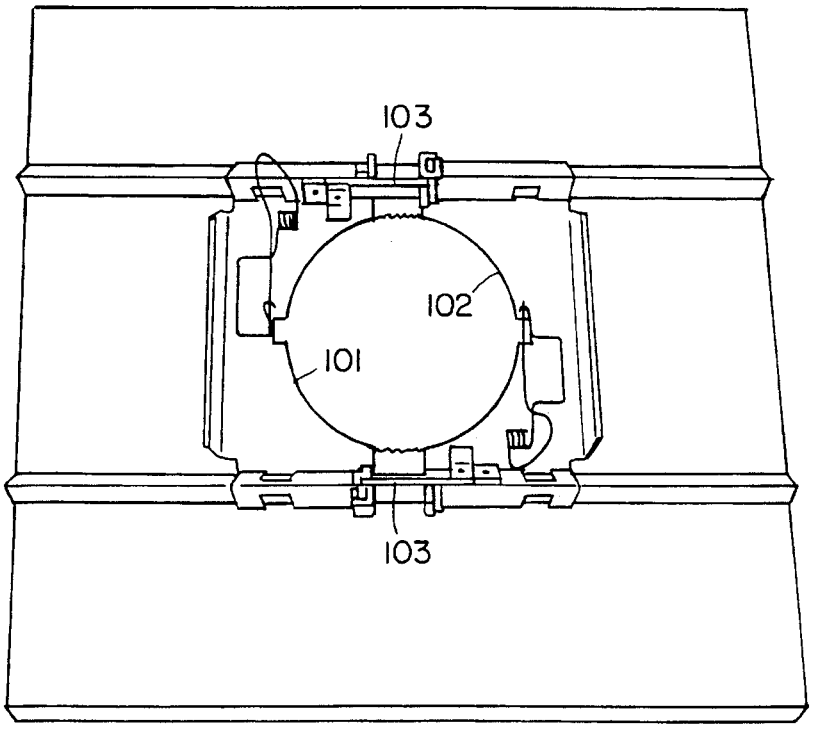

FIG. 10F shows the mounting system in place above a ceiling tile with spacers, such as 103, preventing the inside edges 101 and 102 from closing a larger hole that accommodates a speaker or enclosure of larger diameter.

Figure 10G:
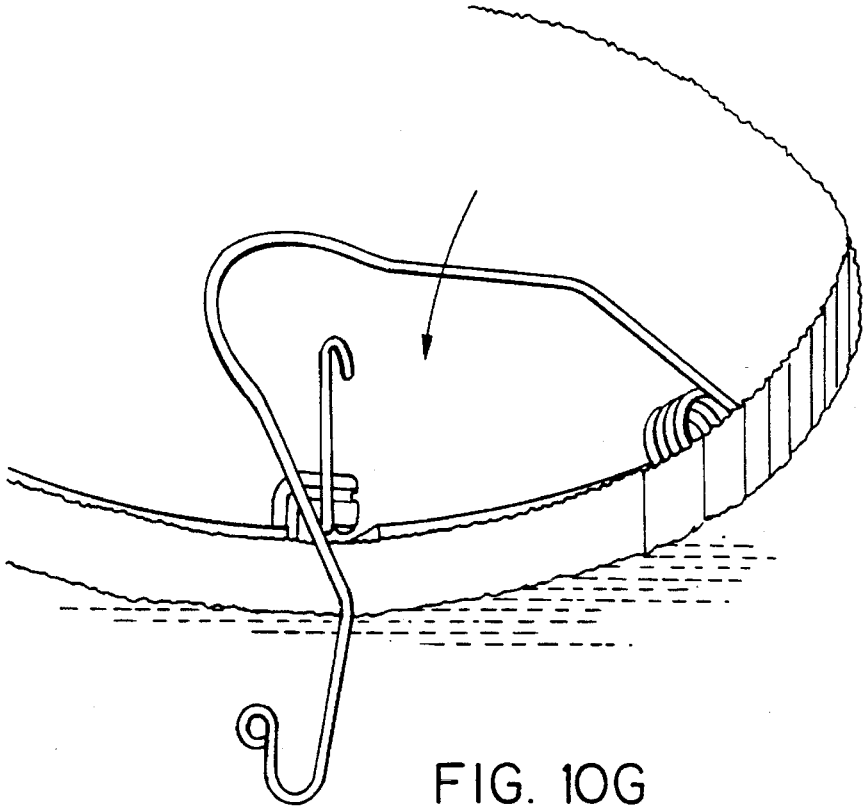

FIG. 10G shows pulling the spring end down through the mounting hole below the ceiling tile.

Figure 10H:
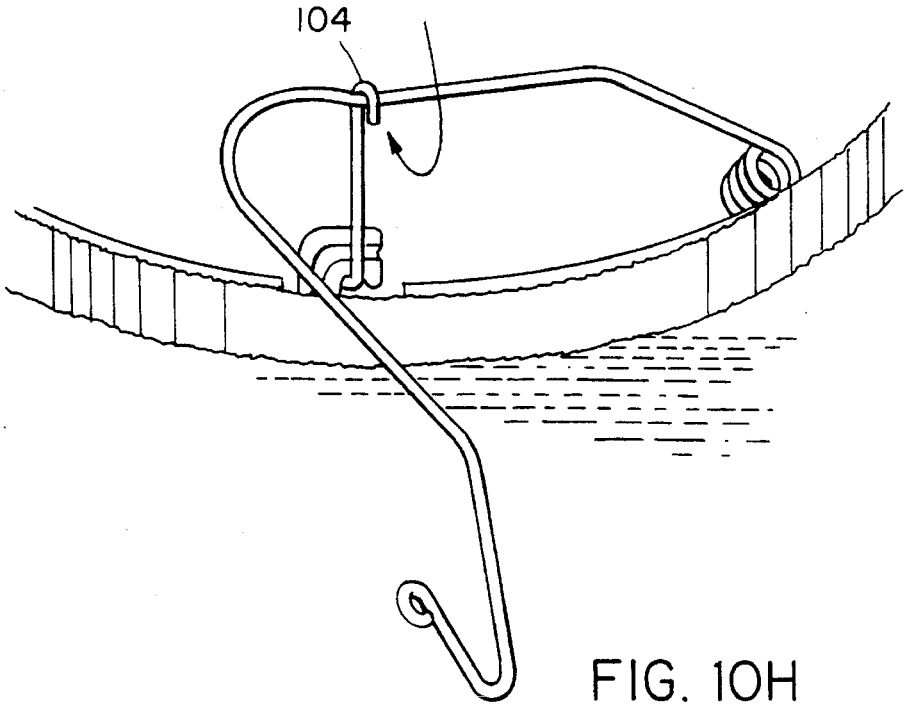

FIG. 10H shows pulling the standing part of the spring below the retaining hook 104 (also 30' in FIG. 6) and securing it under the hook.

Figure 10J:
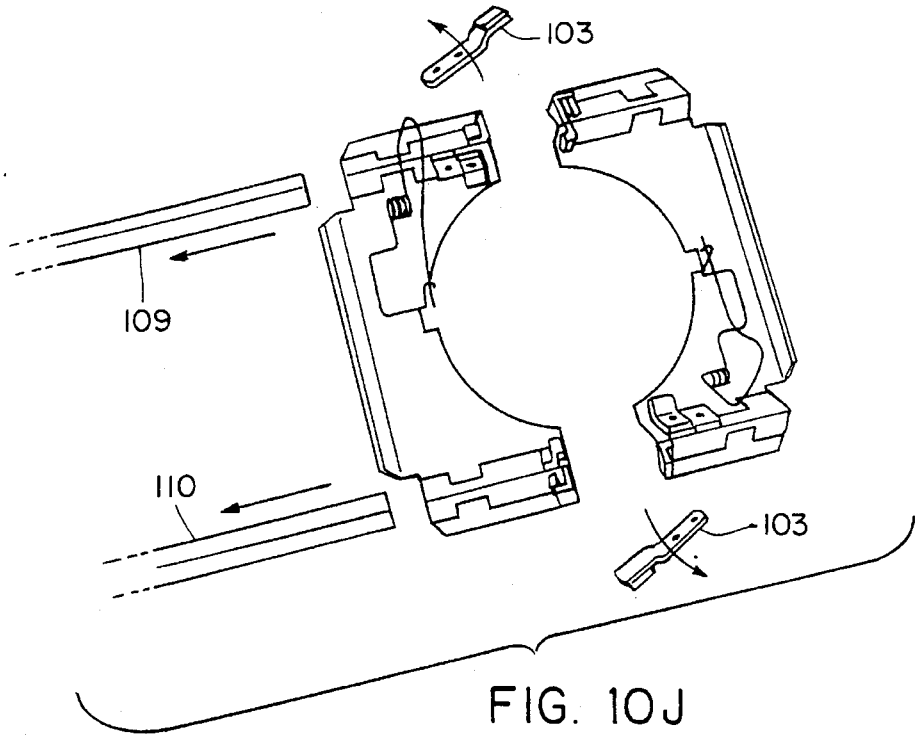

FIG. 10J shows the removal of rails 110 and spacers 103 for installation in structural ceilings of speakers or enclosures of any diameter.

Figure 10K:
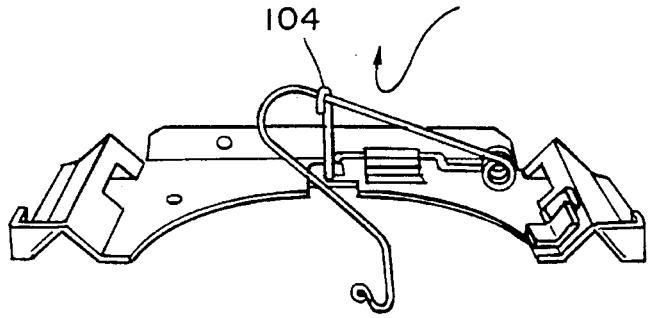
Figure 10L:
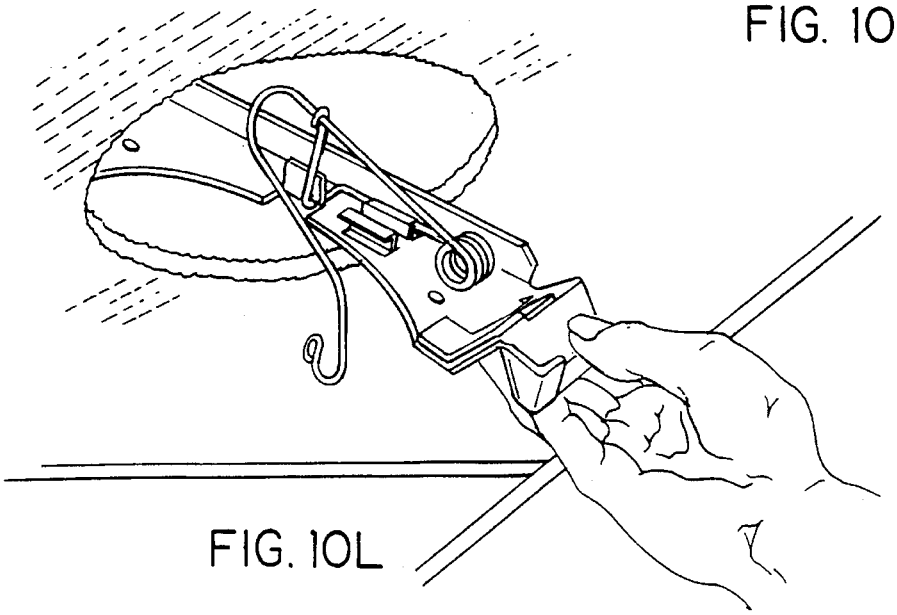
Figure 10M:
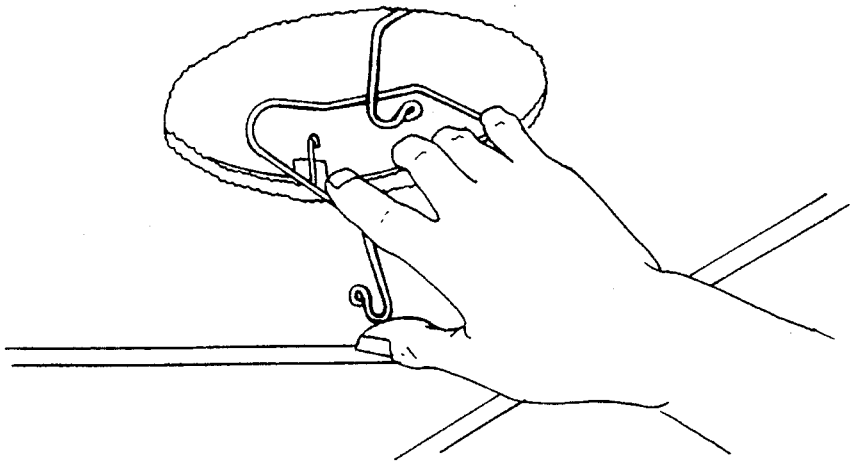

FIG. 10K shows preparation for installation in structural ceilings and retrofit in existing ceilings, such as of gypsum, plaster, wood or other material. Remove rails 109 and 110 and spacers 103 for the assembly accommodating the speaker or enclosure as shown in FIG. 10J. For speakers or enclosures of larger or smaller diameters, hook the spring in place under retaining hook 104 for both brackets 105 and 106 as shown in FIG. 10K. Then insert both brackets through the mounting hole as shown in FIG. 10L. Make sure the brackets are at the edge of the hole, but do not overlap, as shown in FIG. 10M. The mounting system is then ready for speaker wiring, then installation, or speaker installation then wiring. Since wiring is well known to those skilled in the art, a specific wiring procedure is not shown. Wire and or change a tap setting as required if the speaker being installed has a number of taps.

Figure 10N:
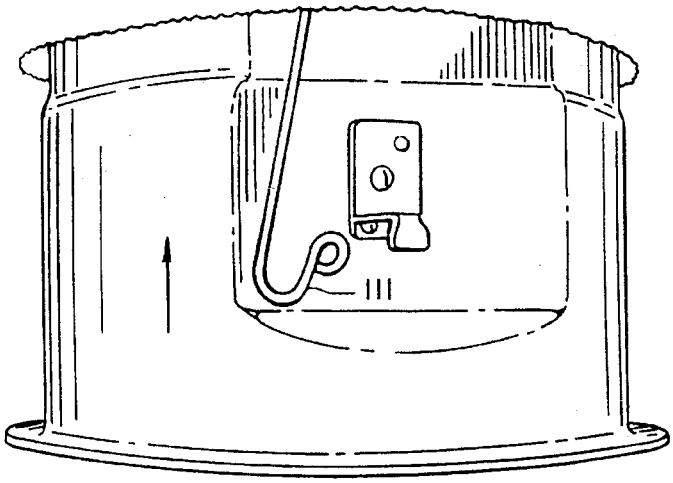
Figure 10O:
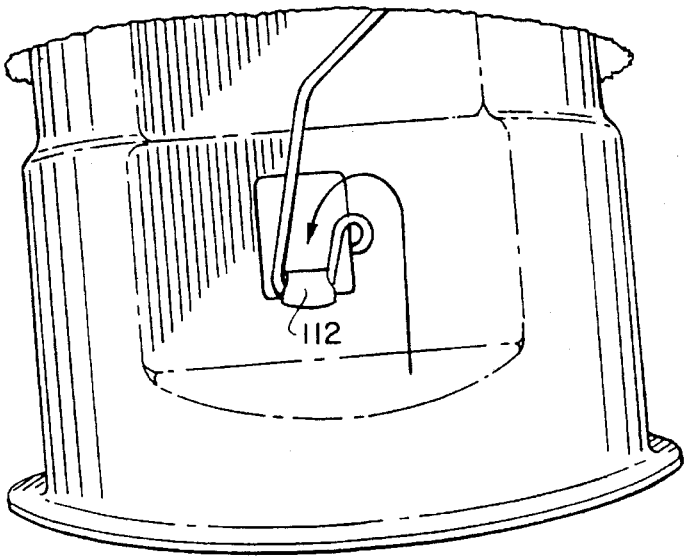
Figure 10P:
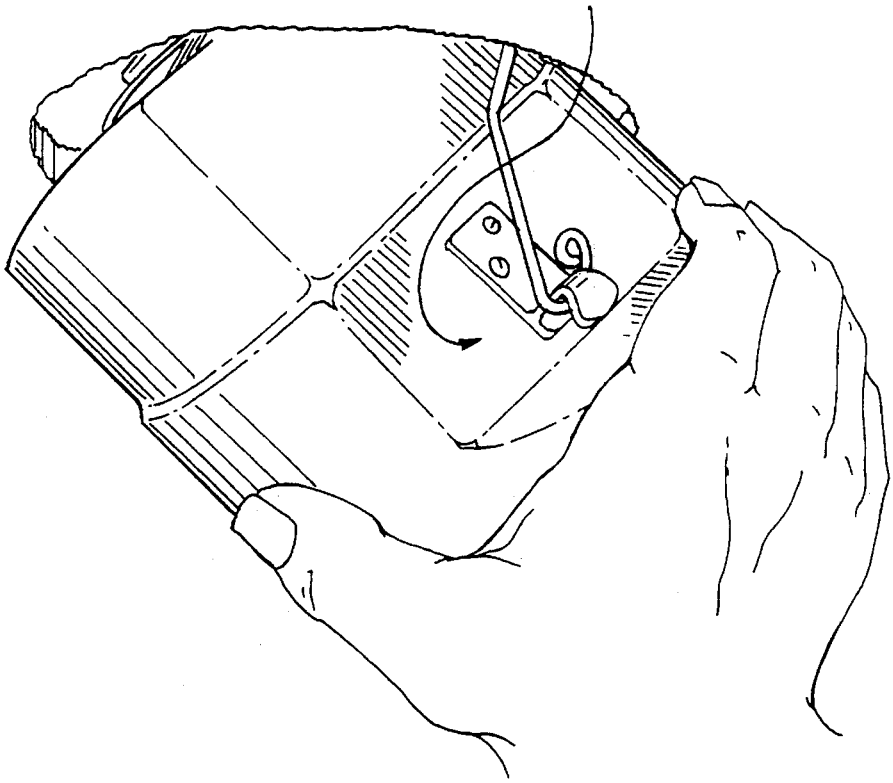
Figure 10Q:
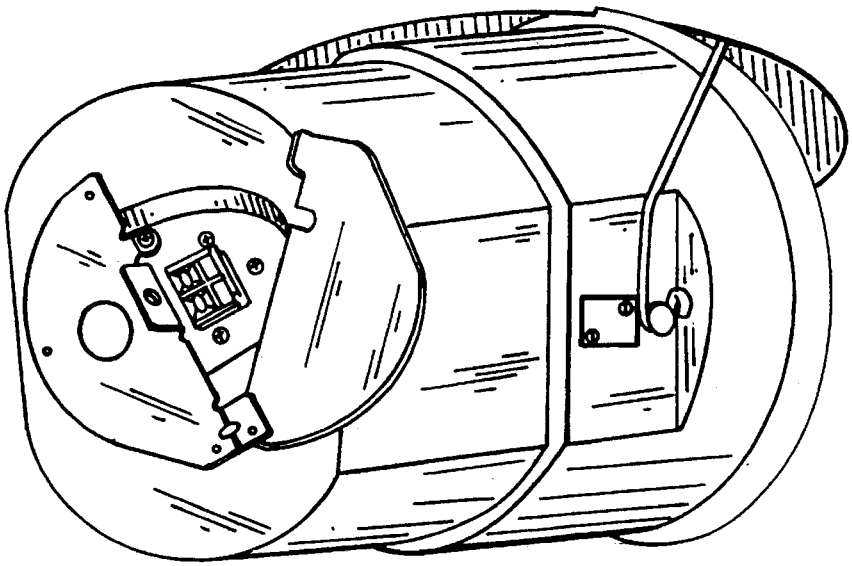
Figure 10R:
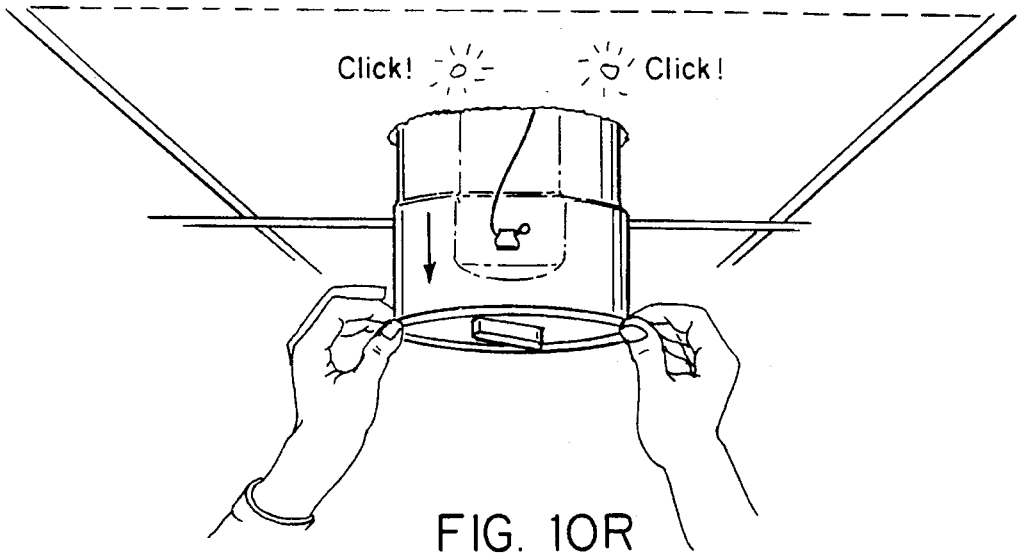
Figure 10S:
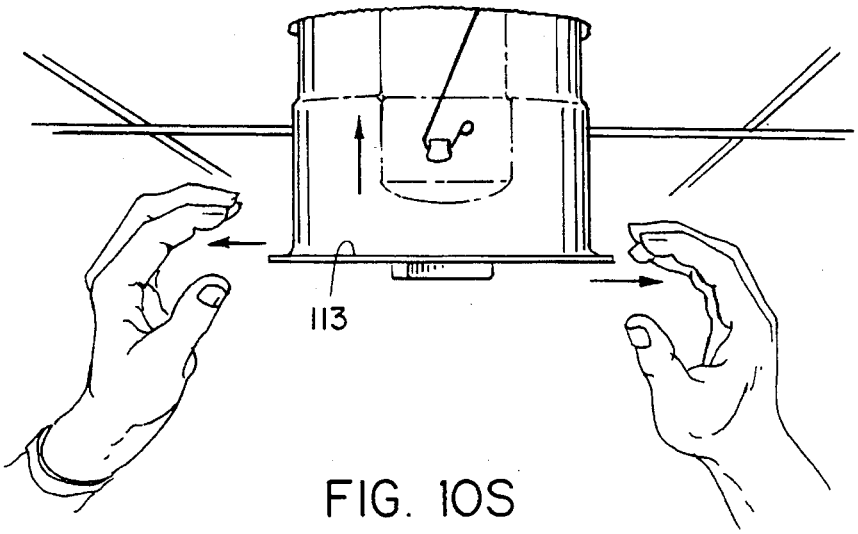
Figure 10T:
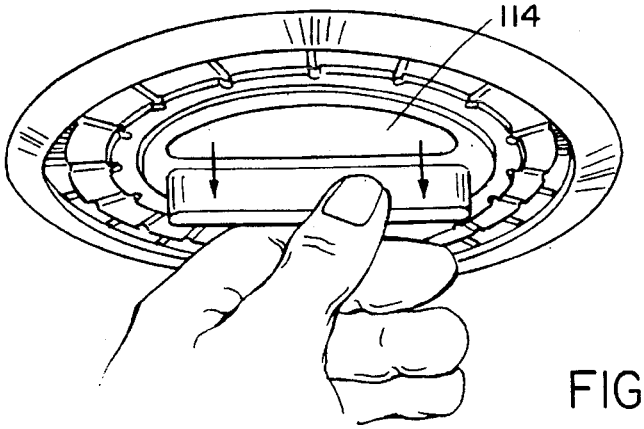

Insert the speaker through the mounting hole and past the spring hooks 111 as shown in FIG. 10N. Then secure the speaker mounting tabs 112 on spring hooks 111, both sides, one of which is shown in FIG. 100. Optionally, if the speaker has not been wired, pull the speaker down and rotate with the terminal cover opening downward as shown in FIG. 10P. Then allow the speaker enclosure and trim to bear on the ceiling opening, allowing access for wiring. If the speaker has been wired and the transformer tap is set, pull the enclosure down until both springs release from the retaining hooks as shown in FIG. 10R. Then release the speaker as shown in FIG. 10S. The springs will then pull the speaker upward until the speaker flange 113 engages the ceiling surface as shown in FIG. 10S. Then remove the optional paint/dust shield 114 and install the grill as shown in FIG. 10T.

Other embodiments are within the claims.

What is claimed is:

1. A mount for mounting a loudspeaker in an aperture in a room boundary structure having an outside surface away from the inside of the room, said mount comprising, a frame constructed and arranged to rest on said outside surface, and a spring having a first end attached to said frame and having a free second end movable from a retracted position toward the inside of said room when said frame is resting on said outside surface to an extended position, said spring constructed and arranged to exert a unidirectional force away from the inside of said room whenever said second end of said spring is displaced from said retracted position toward the inside of said room and said extended position, said free second end of said spring is formed with free second end engaging structure for supporting loudspeaker structure that including a loudspeaker.

2. A mount in accordance with claim 1 wherein said frame is formed with a set of support surfaces extending from a central aperture region which support surfaces are constructed and arranged to engage said outside surface surrounding said aperture.

3. A mount in accordance with claim 2 and further comprising loudspeaker structure that including a loudspeaker, said loudspeaker structure being formed with loudspeaker engaging structure engaging the spring free second end engaging structure that including a loudspeaker, said unidirectional force being large enough so that when frame rests on said outside surface with said loudspeaker structure extending into the inside of said room, said spring draws said loudspeaker structure through said aperture securely mounted in said room boundary structure when said loudspeaker structure is released allowing said second end to move from said extended position toward said retracted position.

4. A mount in accordance with claim 2 wherein said free second end is formed with free second end engaging structure for supporting loudspeaker structure that including a loudspeaker.

5. A mount in accordance with claim 4 and further comprising loudspeaker structure that including a loudspeaker, said loudspeaker structure being formed with loudspeaker engaging structure engaging the spring free second end engaging structure, said unidirectional force being large enough so that when said support surfaces engage said outside surface with said loudspeaker structure extending into the inside of said room, said spring draws said loudspeaker structure through said central aperture region securely mounted in said room boundary structure when said loudspeaker structure is released allowing said second end to move from said extended position toward said retracted position.

6. A method of mounting a loudspeaker structure in a room boundary structure having an outside surface away from the inside of the room including, forming an opening in said room boundary structure corresponding substantially to the cross sectional area of said loudspeaker structure when mounted in said opening, positioning on said outside surface a mount comprising a frame constructed and arranged to rest on said outside surface, said mount having a spring with a first end attached to said frame and a free second end formed with engaging structure for engaging loudspeaker structure that including a loudspeaker, attaching said loudspeaker structure that including a loudspeaker to said engaging structure with said loudspeaker structure inside the room, and releasing said loudspeaker structure while engaged by said engaging structure to allow said spring to pull said loudspeaker structure through said opening.

7. A mount for mounting a loudspeaker in an aperture in a room boundary structure having an outside surface away from the inside of the room, said mount comprising, a frame constructed and arranged to rest on said outside surface, and a spring having a first end constructed and arranged for connection to one of said frame and said loudspeaker and having a free second end movable from a retracted position toward the inside of said room when said frame is resting on said outside surface to an extended position, said spring constructed and arranged to exert a unidirectional force away from the inside of said room whenever said second end of said spring is displaced from said retracted position toward the inside of said room and said extended position, and said free second end of said spring is formed with free second end engaging structure for supporting loudspeaker structure that including a loudspeaker.

* * * * *

UNITED STATES PATENT AND TRADEMARK OFFICE

CERTIFICATE OF CORRECTION

PATENT NO. : 5,574,796

DATED : November 12, 1996

INVENTOR(S) : William J. Keezer

It is certified that error appears in the above-identified patent and that said Letters Patent is hereby corrected as shown below:

Item [73], Assignee:

On the cover page, "Farmingham" should read --Framingham--.

Column 5, claim 3, second line, delete "that".

Sixth line, delete "that including a loudspeaker".

Eighth line, before "frame" insert --said--.

Ninth line, after "structure" insert --including a loudspeaker--.

Eleventh line, after "structure" insert --including a loudspeaker--.

Column 6, line 1, delete "that".

Line 4, delete "that".

Line 32, delete "that".

Line 34, delete "that".

Line 58, delete "that".

Signed and Sealed this

Thirtieth Day of June, 1998

*Attest:*

*Attesting Officer*

Bruce Lehman

BRUCE LEHMAN

*Commissioner of Patents and Trademarks*